US006203367B1

(12) United States Patent
Wu

(10) Patent No.: US 6,203,367 B1
(45) Date of Patent: Mar. 20, 2001

(54) ELECTRICAL CONNECTOR

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/481,130

(22) Filed: Jan. 11, 2000

Related U.S. Application Data

(62) Division of application No. 09/309,142, filed on May 10, 1999, now Pat. No. 6,012,954.

(51) Int. Cl.[7] ..... H01R 13/73
(52) U.S. Cl. ..... 439/567; 439/607
(58) Field of Search ..... 439/567, 571, 439/572, 607–610

(56) References Cited

U.S. PATENT DOCUMENTS 5,125,853 * 6/1992 Hashiguchi ..... 439/607
5,407,364 * 4/1995 Tzeng et al. ..... 439/567
5,709,556 * 1/1998 Tan et al. ..... 439/567
5,797,769 * 8/1998 Yang et al. ..... 439/567
5,807,135 * 9/1998 Clark ..... 439/567
5,921,811 * 7/1999 Hsu ..... 439/567
6,022,243 * 2/2000 Yang et al. ..... 439/567
6,036,537 * 3/2000 Wu et al. ..... 439/567

* cited by examiner

*Primary Examiner*—Gary Paumen
(74) *Attorney, Agent, or Firm*—Wei Te Chung

(57) ABSTRACT

An electrical connector includes an insulative housing defining a slot for receiving a plurality of pins therein each having a U-shaped section. A pin retainer includes blocks integrated together and received in the slot. Each block has an insert portion fit into the U-shaped section of each pin thereby securing the pin in the slot. Two board locks, each having a channel-like portion receiving an expanded end of a fastener therein with an elongated fastener body extending through holes provided on the housing, secure the connector to a circuit board. The channel-like portion of the board lock has a first side defined by two spaced fingers which receive and retain the fastener body therebetween and an opposite second side from which a support section extends. A circuit board engaging section extends from the support section and is received in a slot defined on the circuit board with the support section directly positioned on the circuit board. The second side of the channel-like portion is dimensioned to have the support section substantially located at a central position with respect to the connector whereby a portion of the connector is located below the circuit board when the connector is supported on the circuit board by support section.

1 Claim, 6 Drawing Sheets

ELECTRICAL CONNECTOR

This is a divisional application of the application Ser. No. 09/309,142 filed May 10, 1999, now U.S. Pat. No. 6,012,954.

BACKGROUND OF THE INVENTION

1. Field of the Invention

The present invention relates an electrical connector.

2. The Prior Art

Electrical connections between electrical systems are usually provided by means of electrical connectors, which may be classified as receptacle connectors and plug connectors mating with each other to form the desired electrical connection.

In FIG. 1 of the attached drawings, a conventional D-type electrical connector 10 is shown, which comprises an insulative housing 16 fixed to a circuit board 22 by means of board lock members 12. The housing 16 defines a plurality of channels 21 each receiving a conductive pin 20 therein. Each of the pins 20 has an extension soldered to the circuit board 22. A spacer 24 is attached to the housing 16 by means of resilient barbs 26 to hold the pins 20 in position. A shielding shell 18 is fit over the housing 16 and fasteners 14 extend through the board lock members 12, the housing 16 and the shell 18 to secure them together.

The conventional connector has several disadvantages, such as:

(1) The connector 10 is completely located on a top face 22*a* of the circuit board 22 whereby the connector 10 occupies a large amount of space on the circuit board 22.

(2) Since the connector 10 is mounted on the top face 22*a* of the circuit board 22, the electronic elements associated with the circuit board 22 must also be arranged on the top face 22*a* in order to be electrically connected to the connector 10 thereby preventing utilization of a bottom side face 22*b* of the circuit board 22.

(3) In the conventional design, the pins 20 must be in proper alignment with the respective channels 21 of the housing 16 in order to correctly insert the pins 20 therein. Incorrect insertion of pins or undesired deformation of the pins frequently results which leads to inefficient productivity.

(4) With the number of pins accommodated in the housing increased, the size of the pin receiving channels is reduced which complicates the manufacture the housing.

(5) In the conventional design, the connector is mounted to the circuit board by means of the board lock members that rigidly attach the connector to the circuit board so that adjustment of the spatial relationship between the shielding shell 18 that is fit over the housing 16 and a casing of the circuit board is difficult which may lead to an improper physical engagement between the shielding shell and the casing and thus no grounding may be obtained.

It is desirable to have an electrical connector which has a structure that overcomes the problems discussed above.

SUMMARY OF THE INVENTION

Accordingly, an object of the present invention is to provide an electrical connector which allows a plurality of conductive pins to be simultaneously inserted into a housing thereof so as to enhance the manufacturing efficiency of the connector and to reduce the likelihood of damage to the pins.

Another object of the present invention is to provide an electrical connector wherein a housing of the connector has a simplified structure so as to reduce the manufacturing cost and to facilitate the manufacture thereof.

A further object of the present invention is to provide an electrical connector wherein the board lock members thereof allow a portion of the connector to be located on an opposite side of a circuit board from which the connector is mounted so as to reduce the space occupied by the connector on the circuit board.

Still another object of the present invention is to provide an electrical connector which is mounted to a circuit board by means of elastically deformable parts thereby allowing the spatial relationship between a shielding shell and the circuit board and thus a casing of the circuit board to be adjustable, whereby the electrical engagement between the shielding shell and the circuit board may be properly maintained.

To achieve the above objects, an electrical connector in accordance with the present invention comprises an insulative housing defining a slot for receiving a plurality of pins therein each having a U-shaped section. A pin retainer comprises a plurality of blocks integrated together and received in the slot. Each of the blocks has an insert portion fit into the U-shaped section of each of the pins thereby securing the pin in the slot. Two board locks, each having a channel-like portion receiving an expanded end of a fastener therein with an elongate fastener body extending through holes defined in the housing, secure the connector to a circuit board. The channel-like portion of the board lock has a first side defined by two spaced fingers which receive and retain the fastener body therebetween and an opposite second side from which a support section extends. A circuit board engaging section extends from the support section and is received in a slot defined on the circuit board with the support section directly positioned on the circuit board. The second side of the channel-like portion is dimensioned to have the support section substantially located at a central position with respect to the connector whereby a portion of the connector is located below the circuit board when the connector is supported on the circuit board by the support section. The second side of the channel-like portion and the support section provide sufficient resiliency that allows the spatial relationship between the connector and the circuit board to be adjustable.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENTS

Figure 1:
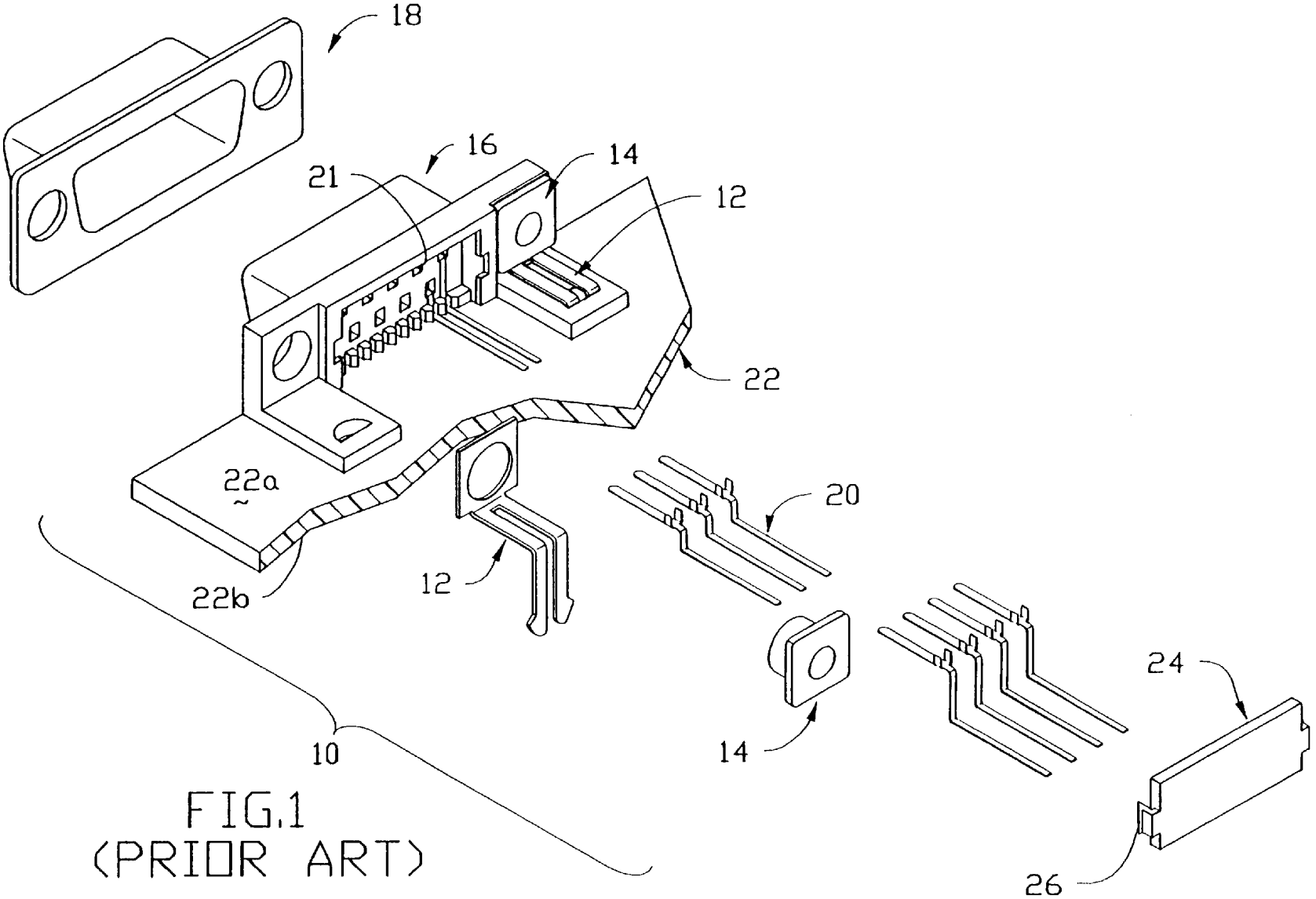
FIG.1 (PRIOR ART)
FIG. 1 is an exploded view of a conventional electrical connector.

Referring to the drawings and in particular to FIG. 1, an electrical connector 30 constructed in accordance with the present invention comprises an insulative housing 34 having a body portion 48 and a projection 44 extending from an outer face of the body portion 48 to be received in and shielded by a shielding shell 32. The body portion 48 defines a plurality of slots 50 between an inner face of the body portion 48 and the projection 44 for each receiving a plurality of conductive pins 36 therein. In the embodiment illustrated, the body portion 48 has three slots 50.

Figure 3:
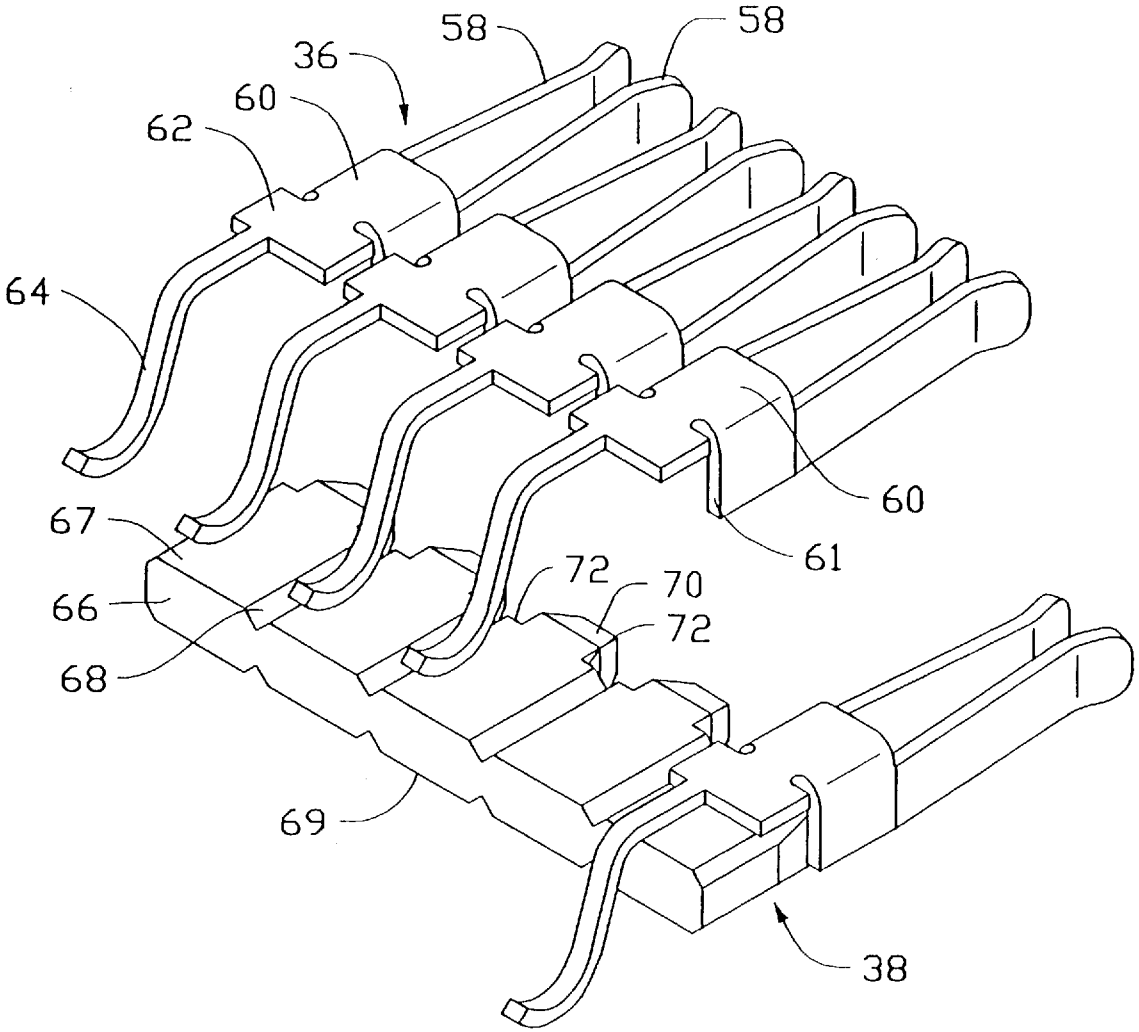
FIG. 3 is a perspective view of conductive pins and a pin retainer of the electrical connector in accordance with the present invention.
Figure 4:
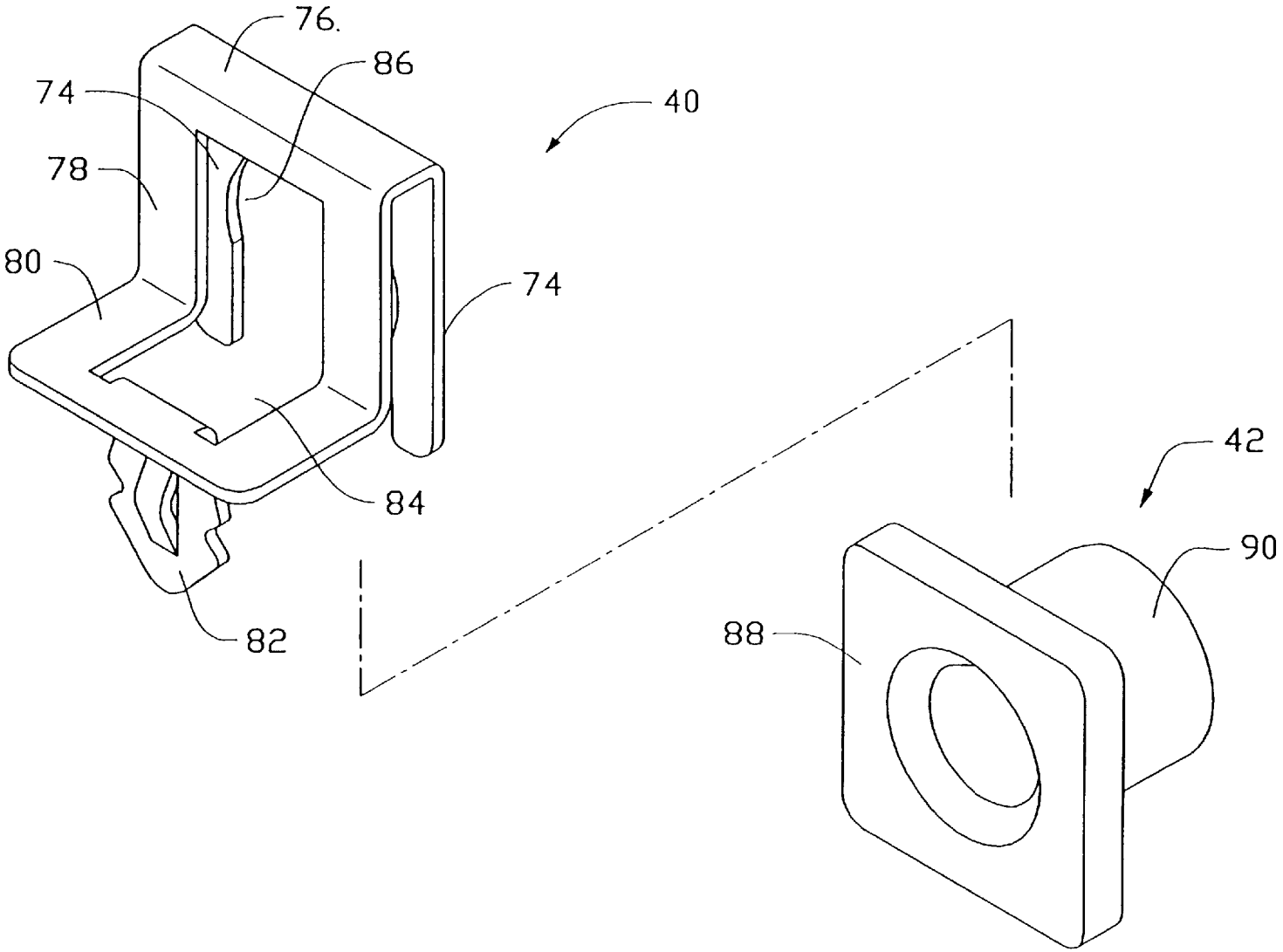
FIG. 4 is a perspective view of a board lock member of the electrical connector in accordance with the present invention.

Besides the pins 36, each slot 50 receives a pin retainer 38 therein for securing the pins 36 in the slot 50. With reference to FIG. 3, each pin 36 comprises two spaced resilient arms 58 which are fixed together by means of a connection portion 60. The connection portion 60 in the embodiment illustrated has a U-shaped configuration with a central wall and two spaced side walls (both not labeled) extending from opposite sides of the central wall. The two side walls of the connection portion 60 have a first side edge (not labeled) from which the two resilient arms 58 extend and a second side edge 61. The connection portion 60 also has a flat portion 62 attached to the second side edge 61 of the central wall.

Figure 5:
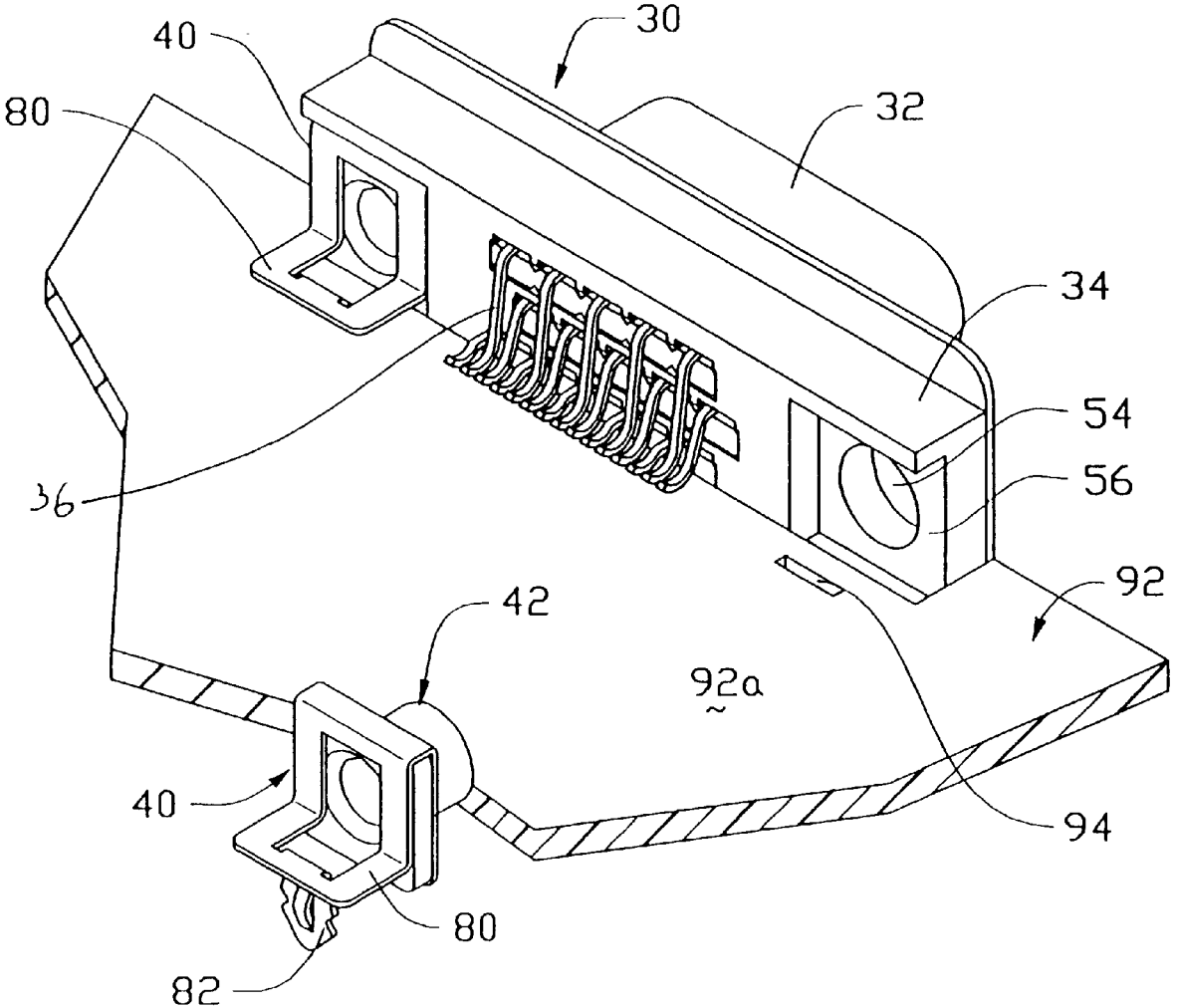
FIG. 5 is a perspective view of the electrical connector of the present invention mounted to a circuit board.
Figure 6:
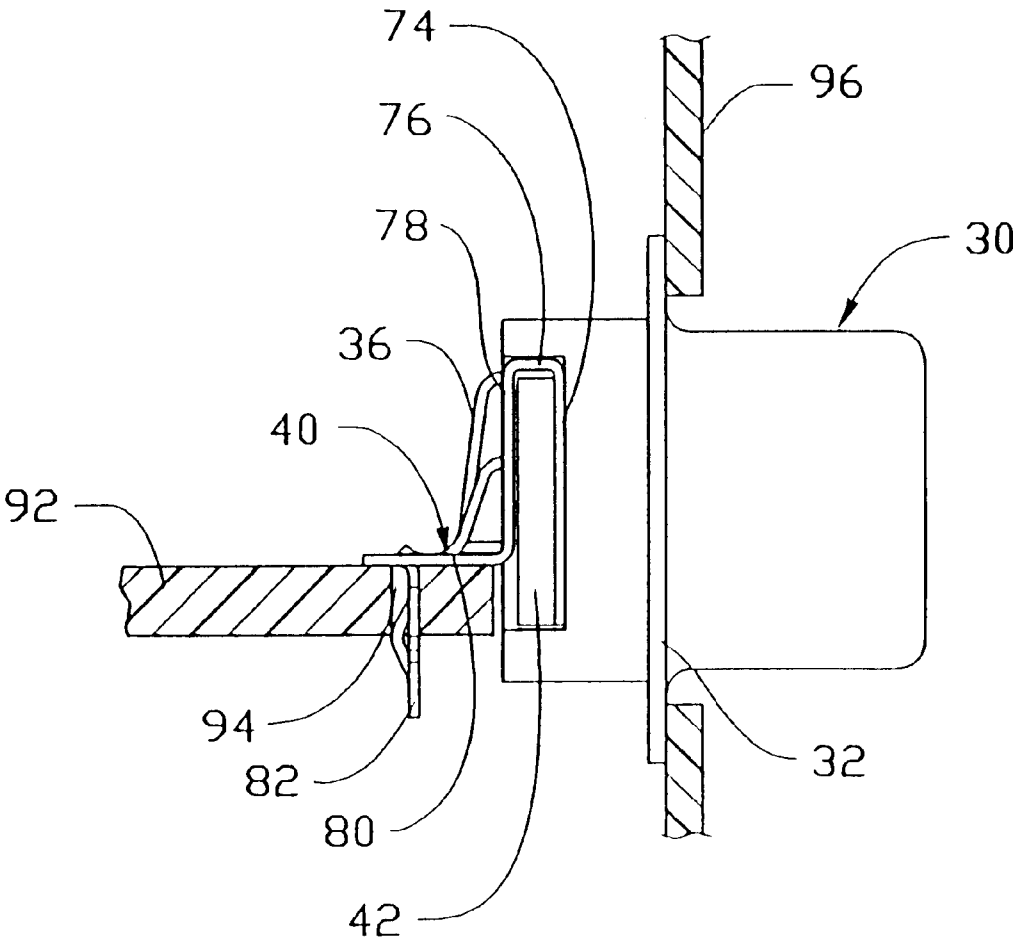
FIG. 6 is a side elevational view of the electrical connector of the present invention mounted to a circuit board and supported by a casing of the circuit board.

Each pin 36 also has a curved extension 64 extending from the flat portion 62 in a direction away from the first side edge of the connection portion 60 for electrically engaging with a circuit board 92 (FIGS. 5 and 6).

Figure 2:
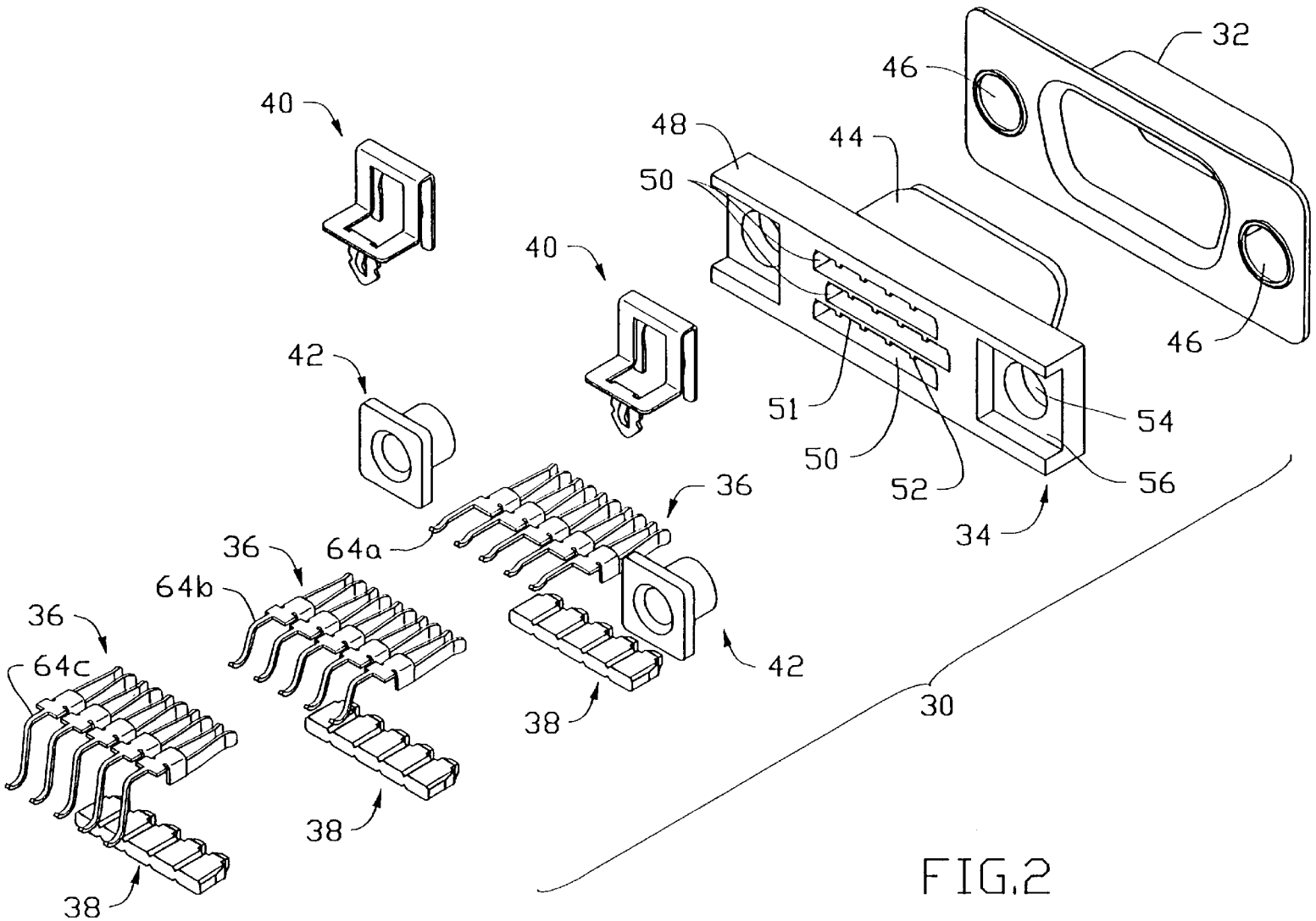
FIG. 2 is an exploded view of an electrical connector constructed in accordance with the present invention.

As shown in the FIGS. 2, 5 and 6, the curved extensions 64 of the pins 36 received in different slots 50 have different curved configurations 64*a*, 64*b* and 64*c* to compensate for the difference in height between the circuit board 92 and the different slots 50.

Referring back to FIG. 3, the pin retainer 38 comprises a plurality of retaining blocks 66 each having an insert portion 70 extending therefrom to be fit into the connection portion 60 of the corresponding pin 36. The insert portion 70 has a cross section smaller than the retaining block 66 thereby defining a shoulder 72 therebetween which is brought into contact with the side edges 61 of the side walls of the connection portion 60 when the insert portion 70 is fit into the connection portion 60.

Preferably, the retaining blocks 66 to be received in the same slot 50 are integrated together to form a unitary member for facilitating insertion of the blocks 66 into the slot 50. The unitary member of the pin retainer 38 has a first face 67 and an opposite second face 69 at least one of which defines a groove 68, preferably triangular, thereon between adjacent retaining blocks 66. At least one rib 52 corresponding to and received in the groove 68 of the pin retainer 38 is formed projecting into the slot 50 on at least one of two opposite inner faces 51 thereof for positioning purposes.

The pin retainer 38 is fit into the slot 50 to interpose the flat portion 62 between one of the faces of the pin retainer 38 (for example the first face 67 in the embodiment illustrated) and the corresponding inner face 51 of the slot 50. This secures the pins 36 in the slots 50.

With reference to FIGS. 2, 4–6, the connector 30 comprises at least one, and preferably two, board lock members 40, each comprising a channel-like portion having a first side formed by two spaced fingers 74 and a second side 78 having an extension portion 80 which is substantially normal to the second side 78. The extension portion 80 is positionable on a top face 92*a* of the circuit board 92. An intermediate portion 76 connects the fingers 74 of the first side to the second side 78. Preferably, an opening 84 is defined in the second side 78 and the extension portion 80 thereby providing the second side 78 and the extension portion 80 with more resiliency.

An anchoring pin 82 is provided on the extension portion 80 of the board lock member 40 for fitting into a corresponding slot 94 defined through the circuit board 92 thereby retaining the connector 30 on the circuit board 92.

Each of the board lock members 40 has a fastener 42 associated therewith. The fastener 42 has a cylindrical portion 90 and an expanded end 88 which is received in the channel-like portion of the board lock member 40 whereby the cylindrical portion 90 extends between the two fingers 74. In this respect, the fingers 74 are preferably provided with an arced notch 86 facing each other for receiving and retaining the cylindrical portion 90 of the fastener 42.

The housing 34 and the shielding shell 32 are both provided with through holes 54, 46 through which the cylindrical portions 90 of the fasteners 42 are received to secure the housing 34 and the shielding shell 32 together. Preferably, the housing 34 has a recessed portion 56 associated with each through hole 54 for accommodating the channel-like portion of the board lock member 40 therein.

In accordance with the present invention, the second side 78 of the board lock member 40 is dimensioned so that when the channel-like portion of the board lock member 40 is received in the corresponding recessed portion 56 of the housing 34, a distance is defined between the extension portion 80 of the board lock member 40 and a bottom side of the housing 34, as shown in FIG. 6, so that when the anchoring pin 82 is fit into the slot 94 of the circuit board 92 and the extension portion 80 of the board lock member 40 is positioned on the top face 92*a* of the circuit board 92, a portion of the housing 34 is located below the circuit board 92. This effectively reduces the space occupied by connector 30 on the circuit board 92.

Preferably, the extension portion 80 is substantially located at a central position of the connector 30 whereby the circuit board 92 is located at a central position with respect to the connector 30.

The channel-like portion of the board lock member 40, especially the second side 78 thereof and the extension portion 80, provides resiliency or elastic deformability that allows the spatial relationship between the connector 30 mounted to the circuit board 92 by means of the board lock member 40 and the circuit board 92 and thus a casing 96 (see FIG. 6) enclosing the circuit board 92 to be adjustable. This leads to a proper physical and electrical engagement between the shielding shell 32 and the casing 96. Grounding of the shielding shell 32 may thus be obtained and ensured.

Although the present invention has been described with reference to a preferred embodiment thereof, it is apparent to those skilled in the art that there are a variety of modifications and changes that may be made without departing from the scope of the present invention which is intended to be defined by the appended claims.

What is claimed is:

1. An electrical connector adapted to be mounted to an electrical device having a conductive casing and in electrical engagement with a circuit board inside the casing, comprising:

an insulative housing having a body portion and a projection extending from the body portion, the housing defining an interior space therein for accommodating a plurality of conductive pins adapted to be electrically engageable with the circuit board;

a conductive shielding shell fitting over the projection of the housing and adapted to engage with the conductive casing of the electrical device; and at least one conductive board lock member fixed to the housing and having a U-shaped portion from which an extension portion horizontally extends for being positioned on the circuit board, and an engaging section vertically downwardly extending from the extension portion and being parallel to and offset from the U-shaped portion to be adapted to mechanically and electrically engage with the circuit board for retaining the connector on the circuit board, the board lock member comprising a fastener made from a conductive material and having an expanded end portion received in the U-shaped portion and engaging therewith for establishing an electrical connection between the shielding shell and the board lock member so as to maintain a grounding connection between the circuit board, the connector shell and the casing, wherein said fastener extends through and secures the shielding shell, the housing and the board lock member together.

* * * * *